US010837731B2

(12) United States Patent
An

(10) Patent No.: US 10,837,731 B2
(45) Date of Patent: Nov. 17, 2020

(54) AUTOMATIC CLEANING APPARATUS FOR GUN BARREL

(71) Applicant: SOOSUNG MACHINERY CO., LTD., Ulsan (KR)

(72) Inventor: Sang-Jin An, Ulsan (KR)

(73) Assignee: Soosung Machinery Co., Ltd., Ulsan (KR)

( * ) Notice: Subject to any disclaimer, the term of this patent is extended or adjusted under 35 U.S.C. 154(b) by 0 days.

(21) Appl. No.: 16/649,339

(22) PCT Filed: Nov. 28, 2017

(86) PCT No.: PCT/KR2017/013630

§ 371 (c)(1),
(2) Date: Mar. 20, 2020

(87) PCT Pub. No.: WO2019/066138

PCT Pub. Date: Apr. 4, 2019

(65) Prior Publication Data

US 2020/0271410 A1 Aug. 27, 2020

(30) Foreign Application Priority Data

Sep. 27, 2017 (KR) ..... 10-2017-0124824

(51) Int. Cl.
*F41A 29/02* (2006.01)
*B08B 9/043* (2006.01)

(52) U.S. Cl.
CPC ..... *F41A 29/02* (2013.01); *B08B 9/0436* (2013.01); *B08B 2209/04* (2013.01)

(58) Field of Classification Search
CPC ..... F41A 29/02
USPC ..... 42/95
See application file for complete search history.

(56) References Cited

U.S. PATENT DOCUMENTS

2008/0229644 A1* 9/2008 An ..... F41A 29/00 42/95
2015/0362279 A1* 12/2015 Kim ..... B08B 9/049 42/95

FOREIGN PATENT DOCUMENTS

KR 1006101830000 B1 8/2006
KR 1006626060000 B1 12/2006
KR 1020090013488 A 2/2009
KR 1014115250000 B1 6/2014
(Continued)

OTHER PUBLICATIONS

Grant of Patent from Korean Intellectual Property Office, dated Nov. 1, 2018, 3 pages.

*Primary Examiner* — Reginald S Tillman, Jr.
(74) *Attorney, Agent, or Firm* — Fay Sharpe LLP

(57) ABSTRACT

An automatic cleaning apparatus for a gun barrel is provided. The apparatus includes a cleaning unit rotating in contact with an inner surface of a gun barrel while moving along the inner surface. The cleaning unit includes an internal gear section having mounting recesses disposed along an outer circumference thereof, a connector section inserted into the mounting recess, a cleaning section detachably coupled to the connector section, a fastening section coupled to the internal gear section, and an engaging section having a first part rotatably coupled to the internal gear section and a second part rotatable about the first part so as to open or close a front side of the connector section depending on a rotary direction of the second part.

5 Claims, 4 Drawing Sheets

(56) References Cited

FOREIGN PATENT DOCUMENTS

KR 1017066570000 B1 2/2017

* cited by examiner

[Fig. 1]
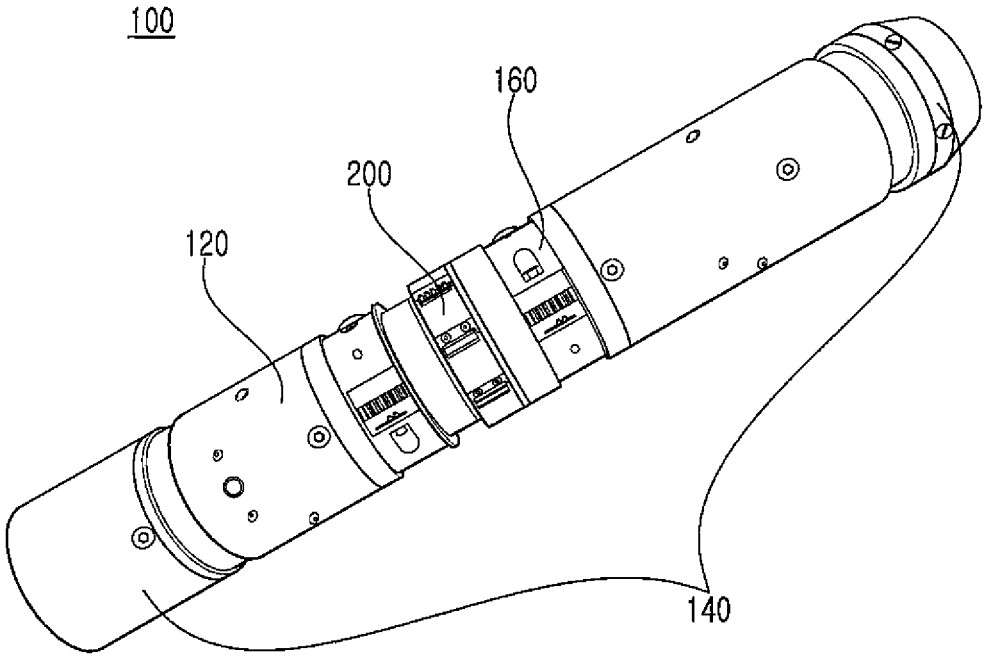

[Fig. 2]
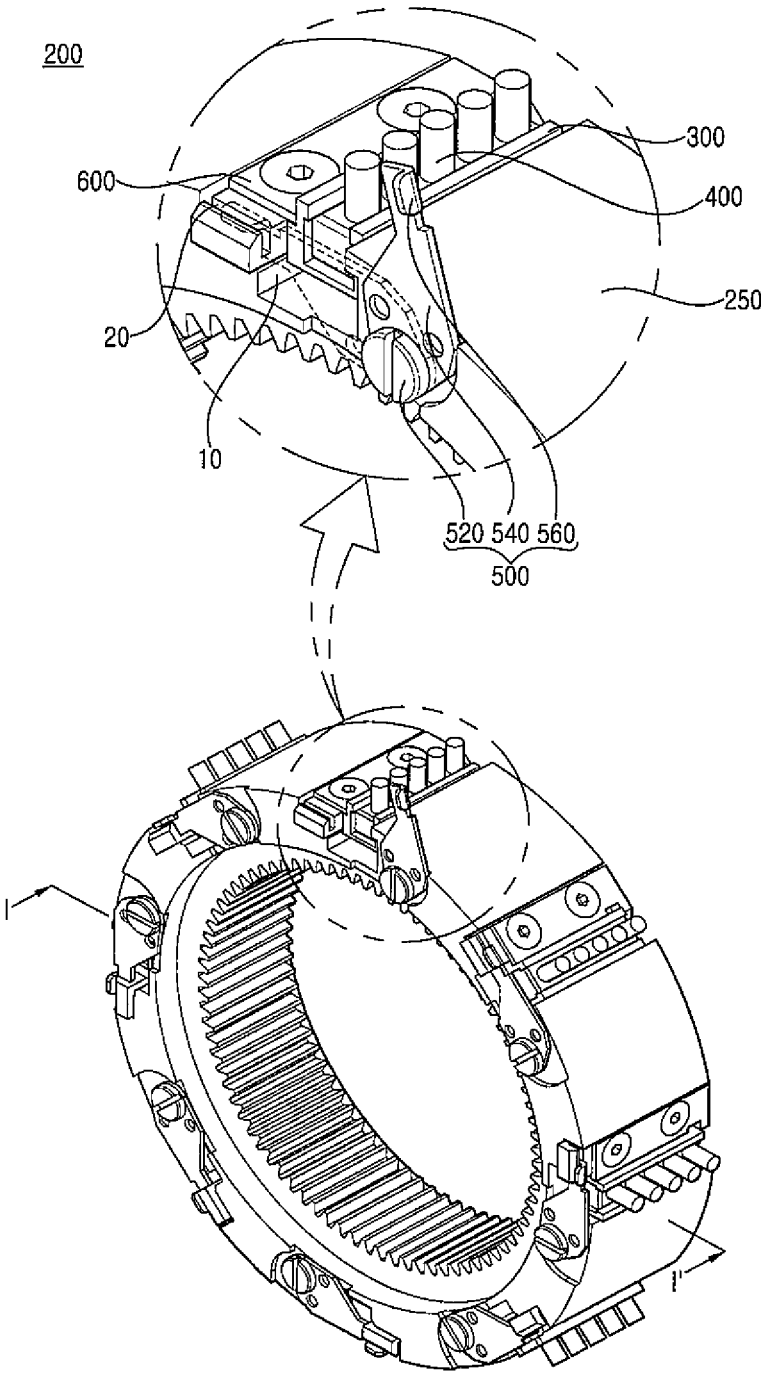

[Fig.3]
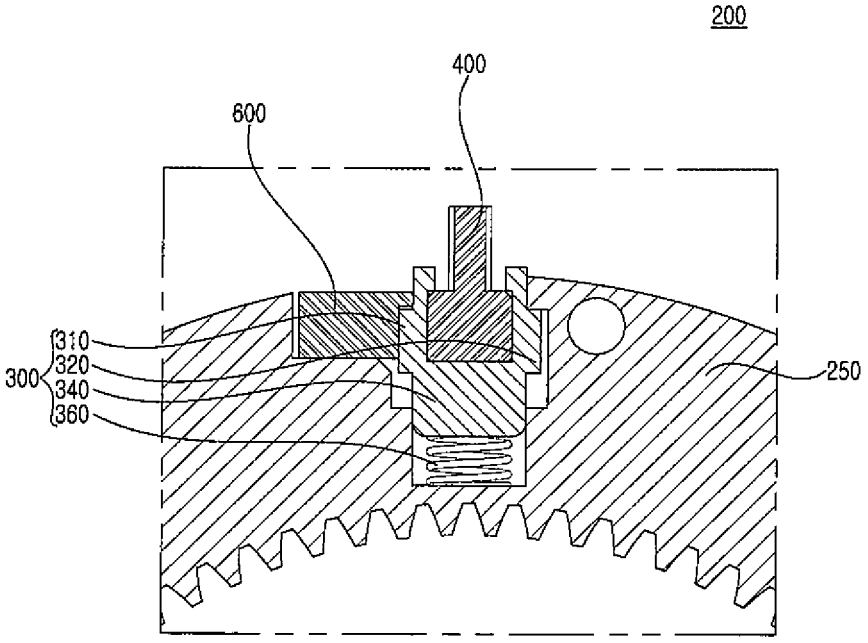

[Fig.4]
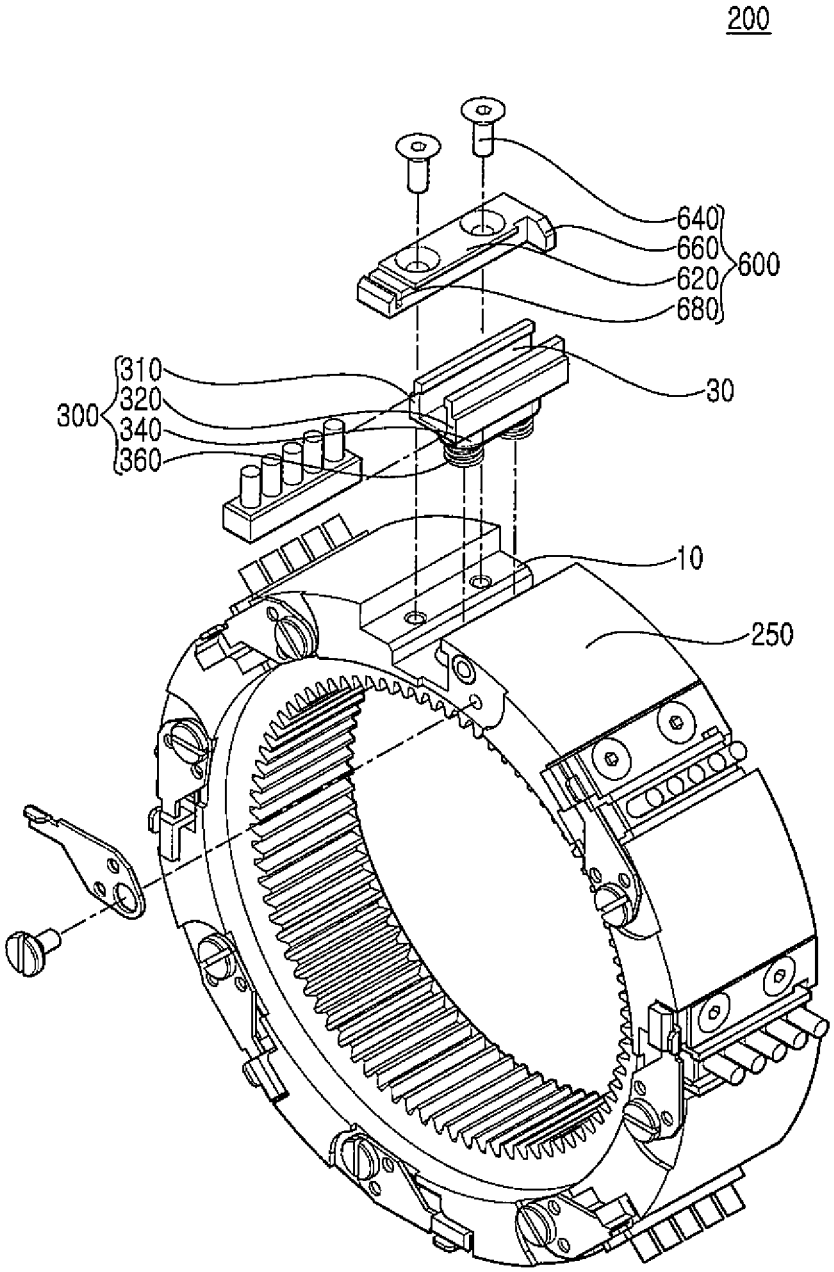

AUTOMATIC CLEANING APPARATUS FOR GUN BARREL

CROSS-REFERENCE TO RELATED APPLICATION

This Application is a Section 371 National Stage Application of International Application No. PCT/KR2017/013630, filed Nov. 28, 2017, the contents of which is hereby incorporated by reference in its entirety.

TECHNICAL FIELD

The present invention relates generally to an automatic cleaning apparatus for a gun barrel and, more particularly, to an automatic cleaning or brushing apparatus for a gun barrel, in which the apparatus has a cleaning unit to which a cleaning means is detachably attached.

BACKGROUND ART

Unless otherwise indicated, it should not be interpreted that the disclosure of this section belongs to a conventional technique of the claimed invention.

Generally, a cleaning apparatus for a gun barrel is an apparatus that cleans or removes the firing residue inside of a fired gun barrel while moving along the inside of the gun barrel, thereby maintaining performance of the gun barrel.

In such a conventional cleaning apparatus, a cleaning means such as brushes or non-woven fabrics, which are attached to an outer surface of a cleaning unit, should be periodically replaced with new ones due to wear during use. However, the conventional cleaning apparatus has a problem in that it takes much time to replace the cleaning means of the cleaning unit.

Korean Patent Registration. No. 10-0662606 discloses an automatic gun barrel-cleaning apparatus, and Korean Patent Registration No. 10-0920446 discloses an automatic gun barrel-cleaning apparatus having an easily detachable cleaning unit.

However, such gun barrel-cleaning apparatuses also have the same problem, so, if cleaning is required in short time, the conventional apparatuses are not suitable as a cleaning means.

DISCLOSURE

Technical Problem

Accordingly, the present disclosure has been made keeping in mind the above problems occurring in the related art, and is intended to provide an automatic cleaning apparatus for a gun barrel, the apparatus being capable of facilitating fast detachable attachment of a cleaning means including brushes or non-woven fabrics to clean the inside of a gun barrel.

It is obvious that the technical problem of the present disclosure is not limited to the above technical problem, and other technical problems may be included in the present disclosure from the following description.

Technical Solution

In one aspect, the present disclosure provides an automatic cleaning apparatus for a gun barrel, the apparatus including: a cleaning unit rotating in contact with an inner surface of a gun barrel while moving forward along the inner surface through a driving action of a driving unit in a main body thereof, the cleaning unit including: an internal gear section having a plurality of longitudinal mounting recesses disposed at regular intervals along an outer circumference thereof; a connector section inserted into a first side of the mounting recess; a cleaning section detachably coupled to the connector section; a fastening section coupled to the internal gear section while pressing down an upper side of the connector section; and an engaging section having a first part rotatably coupled to a front side of the internal gear section and a second part rotatable about the first part so as to open or close a front side of the connector section depending on a rotary direction of the second part.

The fastening section may include a first side extending forwards and having a fitting groove into which the second part of the engaging section is fitted, and a second side horizontally extending towards the first side of the mounting recess so as to fixedly support the cleaning section.

The connector section may include: a pair of connection parts disposed in a symmetrical manner with an insertion hole interposed therebetween to accommodate the cleaning section therein, the connection parts having opposite outer protrusions, respectively; an insertion part extending downwards from a bottom portion of the connection parts towards a center of the internal gear section, the insertion part being inserted into the mounting recess of the internal gear section; and a spring disposed between the insertion part and the mounting recess of the internal gear section.

The fastening section may include: a plate-type body part coupled to the internal gear section; a coupling part extending forwards from the front side of the internal gear section from a front side of the body part, and having a fitting groove into which the second part of the engaging section is fitted; and a block part horizontally extending from a rear side of the body part towards the first side of the mounting recess so as to fixedly support a rear side of the cleaning section.

The engaging section may include: a rotary shaft member rotatably coupled to the front side of the internal gear section: an engaging member extending from the rotary shaft member towards the fitting groove to close the front side of the cleaning section when the engaging section is rotated to close the front side of the connector section; and a protrusion extending from the engaging member so as to be fitted into the fitting groove.

Advantageous Effects

As described above, the automatic cleaning apparatus for a gun barrel has an advantage in easy, fast detachable attachment of the cleaning means including brushes or non-woven fabrics to the cleaning unit.

Further, the cleaning apparatus facilitates fast replacement of brushes or non-woven fabrics of the cleaning means through a rotary fitting structure, instead of a conventional bolting attachment structure, and has an advantage that even when brushes are worn out, they provide strong cleaning force using elastic force of springs disposed in the cleaning unit.

Further, the cleaning apparatus has an advantage that parts associated with replacement of brushes or non-woven fabrics do not require detachment and attachment during detachment or attachment of the brushes or non-woven fabrics, thereby preventing damage or loss thereof.

It should be noted that since the above advantageous effects of the present disclosure are essentially provided by the configuration of the present disclosure irrespective of whether or not the present inventors have recognized them, the above-mentioned effects are merely several illustrative examples according to the present disclosure, so not all effects of the present disclosure are described herein.

The effects of the present disclosure should be additionally recognized by the description throughout this specification, and although not cleanly described herein, the effects should be interpreted as belonging to the present disclosure so long as they may be admitted to be effective in context of this specification by ordinary persons skilled in the art.

DESCRIPTION OF DRAWINGS

FIG. 1 is a perspective view illustrating an automatic cleaning apparatus for a gun barrel according to an embodiment of the present disclosure;

FIG. 2 is a perspective view illustrating a detailed cleaning unit of FIG. 1;

FIG. 3 is a cross-sectional view taken along line I-I' of FIG. 2; and

FIG. 4 is an exploded perspective view of the cleaning unit of FIG. 2.

MODE FOR INVENTION

Hereinbelow, configuration, operation, and effects of an automatic cleaning apparatus for a gun barrel according to preferred embodiments of the present disclosure will be described in detail with reference to the accompanying drawings. In the following description, respective elements are omitted or schematically drawn for convenience and clarity, and illustrated dimensions do not reflect actual dimensions thereof. Further, like elements are indicated by like reference numerals throughout the specification, and reference numerals for the same elements may be omitted in respective drawings.

FIG. 1 is a perspective view illustrating an automatic cleaning apparatus for a gun barrel according to an embodiment of the present disclosure.

FIG. 2 is a perspective view illustrating in detail a cleaning unit of FIG. 1.

As illustrated in FIGS. 1 and 2, the automatic cleaning apparatus 100 includes a main body 120, driving units 140, and a cleaning unit 200.

The automatic cleaning apparatus 100 is an elongated cylindrical apparatus that cleans the inside of a smoothbore gun having no rifling on an inner surface thereof by using the cleaning unit 200 to be brought into close contact with an inner surface of a gun barrel while moving along the inside thereof.

The main body 120 is an elongated cylindrical part and the driving units 140 are respectively disposed at both ends of the main body such that the driving force of the driving units 140 is transferred to the cleaning unit 200 at the middle portion of the main body 120 to rotate the cleaning unit 200 to clean the inside of the gun barrel.

Cleaning brushes or non-woven fabrics to be fitted into the cleaning unit 200 are subjected to wear or damage during use, and worn or damaged brushes or non-woven fabrics should be rapidly replaced with new ones in order for rapid cleaning of the inside of the gun barrel in short time.

Specifically, the cleaning unit 200 includes an internal gear section 250, a connector section 300, a cleaning section 400, an engaging section 500, and a fastening section 600.

The internal gear section 250 is shaped like a ring, wherein a gear part is provided on an inner circumference thereof, and a plurality of longitudinal mounting recesses 10 are disposed at regular intervals along an outer circumference thereof.

Each of mounting recesses 10 is circumferentially recessed in a step form having shallow and deep step parts towards the center of the ring-type internal gear section 250, wherein the shallow step part is formed into a relatively shallow recess and the deep step part is formed into a relatively deep recess.

The internal gear section 250 is gear-coupled with the driving units 140 so that it rotates along with a driving shaft provided along a longitudinal direction of the main body 120 in such a manner as to switch a rotary direction under the control of the automatic cleaning apparatus 100.

The connector section 300 is inserted into the mounting recess 10 from one side of the mounting recess such that a portion thereof protrudes by a distance and is shaft-coupled with the driving shaft of the internal gear section 250, and a lower portion thereof is fitted into the deep step part of the mounting recess 10 of internal gear section 250.

The cleaning section 400 is formed into an elongated bar-type section having replaceable cleaning brushes or non-woven fabrics, which is inserted from a front side towards a rear side of the connector section 300 and coupled to the connector section 300.

The fastening section 600 is placed in the shallow step part of the mounting recess 10 so as to press down an upper portion of an engaging protrusion on one side of the connector section 300 and is bolt-coupled to the internal gear section 250 to prevent the detachment of the connector section 300.

The bottom of the fastening section 600 is positioned at a higher level than that of the connector section 300 in close contact with the internal gear section 250, and an upper end of the fastening section 600 is positioned at a higher level than those of the connector section 300 and the cleaning section 400 coupled to the connector section 300.

The engaging section 500 includes a rotary shaft member 520, an engaging member 540, and a protrusion 560.

The engaging section 500 is provided such that a first side thereof is rotatably coupled to a front side of the internal gear section 250 and a second side thereof is rotated about the first side so as to open or close the front side of the connector section 300 depending on the rotary direction of the second side.

The rotary shaft member 520 is formed into a bolt-type member to relatively rotatably couple one side of the engaging section 500 and the front side of the internal gear section 250, and can regulate a rotary force of the engaging section 500 under the control of coupling force between the engaging section 500 and the internal gear section 250.

The engaging member 540 is formed into a plate-type member that is provided between the rotary shaft member 520 and the internal gear section 250 so as to extend by a distance to close the front side of cleaning section 400 when rotated towards a fitting groove 20 (which is described later) of the fastening section.

The protrusion 560 protrudes by a distance from the engaging member 540 such that front and rear sides thereof are distorted at a specified angle from those of the engaging member 540.

Depending on the rotary direction of the engaging section about the rotary shaft member 520, the protrusion 560 can be fitted into the fitting groove 20 so as to prevent the detachment of the cleaning section 400 from the connector section 300, and the protrusion 560 can be decoupled from the fitting groove 20 so as to separate the cleaning section 400 from the connector section 300.

Since the protrusion 560 is distorted at the specified angle, when inserted into the fitting groove 20, the protrusion is deformed parallel with the front side of the internal gear section 250 so that a restoration force to return the protrusion to its original state acts on the internal gear section 250 in the fitting groove 20.

In order to decouple the protrusion 560 from the fitting groove 20 while the restoration force of the protrusion 560 acts on a wall part of the fitting groove 20, a greater force than the restoration force is required, thereby effectively preventing the detachment of the cleaning section 400 from the connector section 300.

A space of the fitting groove 20 may be formed to be relatively smaller than a volume of the protrusion 560, and when the protrusion 560 is fitted into the fitting groove 20, the internal gear section 250 around the fitting groove 20 presses against the protrusion 560.

An upper portion of the protrusion 560 is partially bent towards the front side of the internal gear section 250 so that, when the protrusion 560 is fitted into the fitting groove 20, the bent portion protrudes forwards from the fitting groove. Thus, the bent portion of the protrusion 560 serves as a grip that is to be held by a user to facilitate the rotation of the engaging member 540.

Thus, when a damaged or worn cleaning section 400 is required to be replaced, convenient removal thereof from the connector section 300 by rotating the engaging member 540 with the grip of the protrusion held by a user is possible.

FIG. 3 is a cross-sectional view taken along line I-I' of FIG. 2.

FIG. 4 is an exploded perspective view of the cleaning unit of FIG. 2.

As illustrated in FIGS. 3 and 4, the connector section 300 includes a first connection part 310, a second connection part 320, an insertion part 340, and a spring 360.

The first and second connection parts 310 and 320 are symmetrically provided with an insertion hole 30 disposed therebetween, wherein the cleaning section 400 is inserted into the insertion hole 30. The first and second connection parts 310 and 320 respectively have opposite engaging protrusions on lateral sides thereof.

Lower ends of the first and second connection parts 310 and 320 connect to form a bottom part that comes into close contact with the bottom of the cleaning section 400 when inserted into the insertion hole 30, thereby supporting the cleaning section 400.

The connector section 300 is fitted into the mounting recess of the internal gear section 250 such that the engaging protrusion of the second connection part 320 is inserted into an engaging recess outwardly recessed by a distance from a wall portion of the deep step part of the mounting recess in the internal gear section 250, and the upper portion of the second connection part 320 is brought into close contact with the upper portion of the mounting recess of the internal gear section 250. Thus, the connection section is coupled to the internal gear section 250.

The insertion part 340 extends downwards in the form of an oval section by a distance from the bottom part between the first and second connection parts 310 and 320. When the connector section 300 is coupled to the internal gear section 250, the insertion part 340 is inserted into an oval recess in the deep step part of the mounting recess in the internal gear section 250.

Springs 360 are provided on front and rear sides of the bottom of the insertion part 340 such that upper portions thereof are respectively partially inserted into the front and rear sides of the bottom of the insertion part 340 and lower portions thereof are partially inserted into the oval recess. The springs 360 are inserted into the oval recess in a compressible manner together with the insertion part 340.

When the cleaning section 400 comes into close contact with the inner surface of a gun barrel, the cleaning section 400 is pressed against the center of the internal gear section 250 by the inner surface of the gun barrel. Here, the springs 360 resiliently push out the cleaning section 400 towards the inner surface of the gun barrel, thereby maintaining close adherence between the cleaning section 400 and the inner surface of the gun barrel.

As such, the springs 360 serve to maintain the close adherence between the cleaning section 400 and the inner surface of the gun barrel, thereby advantageously maintaining constant cleaning force of the cleaning section 400 that is being driven along with the rotation of the internal gear section 250.

The fastening section 600 includes a body part 620, bolts 640, a rear block part 660, and a front coupling part 680.

In the fastening section 600 coupled to the internal gear section 250, the front coupling part extends forwards by a distance and has a fitting groove 20 into which the protrusion of the engaging section 500 is fitted, and the rear block part horizontally extends by a distance towards the deep step part of the mounting recess 10 so as to fixedly support a rear side of the cleaning section 400.

When coupled to the internal gear section 250, the fastening section 600 presses down the upper portion of the engaging protrusion of the first connection part 310 so as to prevent the detachment of the connector section 300 from the mounting recess 10.

Thus, with the configuration in which the protrusion of the engaging section 500 is fitted into the fitting groove 20 of the front coupling part of the fastening section 600 and the rear block part comes into close contact with the connector section 300 in the mounting recess 10, the connector section 300 and the cleaning section 400 are prevented from being detached from the mounting recess 10, and the connector section 300 is stably supported during the rotation of the internal gear section 250 in the gun barrel.

The body part 620 is a plate-type part that is bolt (e.g. 640)-coupled to the upper portion of the internal gear section 250 in the shallow step part of the mounting recess 10 and presses down the upper portion of the engaging protrusion of the first connection part 310.

The coupling part 680 extends by a distance forwards from the front side of the internal gear section 250 at the front side of the body part 620. The coupling part 680 is provided with the fitting groove 20 into which the protrusion of the engaging section 500 is fitted.

The rear block part 660 horizontally extends by a distance from the rear side of the body part 620 towards the deep step part of the mounting recess 10. When the fastening section 600 is coupled to the internal gear section 250, the rear block part 660 comes into close contact with the rear side of the cleaning section 400 so as to prevent the cleaning section 400 from being detached from the internal gear section 250.

Although preferred embodiments of the present disclosure have been described with reference to the accompanying drawings, it should be understood that since the configurations illustrated in the embodiments and drawings are provided merely for illustrative purposes and they do not describe the entire technical scope of the present disclosure, there may be various replaceable equivalents and modifications at the filing time of this application. Therefore, the described embodiments should be understood as being illustrative in all aspects and not limiting. The scope of the present disclosure is defined by following claims, rather than the detailed description, and changes or modifications drawn from the spirit and scope of claims and their equivalents should be construed as being included in the scope of the present disclosure.

INDUSTRIAL APPLICABILITY

The automatic cleaning apparatus for a gun barrel can be used for apparatus having gun barrel to clean or remove firing residue inside of the gun barrel effectively.

DESCRIPTION OF REFERENCE NUMERALS

100: Automatic cleaning apparatus for a gun barrel
200: Cleaning unit
300: Connector section
400: Cleaning section
500: Engaging section
600: Fastening section

The invention claimed is:

1. An automatic cleaning apparatus for a gun barrel, the apparatus comprising:

a cleaning unit rotating in contact with an inner surface of a gun barrel while moving forward along the inner surface through a driving action of a driving unit in a main body thereof, the cleaning unit including:

an internal gear section having a plurality of longitudinal mounting recesses disposed at regular intervals along an outer circumference thereof;

a connector section inserted into a first side of the mounting recess;

a cleaning section detachably coupled to the connector section;

a fastening section coupled to the internal gear section while pressing down an upper side of the connector section; and an engaging section having a first part rotatably coupled to a front side of the internal gear section and a second part rotatable about the first part so as to open or close a front side of the connector section depending on a rotary direction of the second part.

2. The apparatus according to claim 1, wherein the fastening section includes a first side extending forwards and having a fitting groove into which the second part of the engaging section is fitted, and a second side horizontally extending towards the first side of the mounting recess so as to fixedly support the cleaning section.

3. The apparatus according to claim 1, wherein the connector section includes:

a pair of connection parts disposed in a symmetrical manner with an insertion hole interposed therebetween to accommodate the cleaning section therein, the connection parts having opposite outer protrusions, respectively;

an insertion part extending downwards from a bottom portion of the connection parts towards a center of the internal gear section, the insertion part being inserted into the mounting recess of the internal gear section; and a spring disposed between the insertion part and the mounting recess of the internal gear section.

4. The apparatus according to claim 3, wherein the fastening section includes:

a plate-type body part coupled to the internal gear section;

a coupling part extending forward from the front side of the internal gear section from a front side of the body part, and having a fitting groove into which the second part of the engaging section is fitted; and a block part horizontally extending from a rear side of the body part towards the first side of the mounting recess so as to fixedly support a rear side of the cleaning section.

5. The apparatus according to claim 4, wherein the engaging section includes:

a rotary shaft member rotatably coupled to the front side of the internal gear section:

an engaging member extending from the rotary shaft member towards the fitting groove to close the front side of the cleaning section when the engaging section is rotated to close the front side of the connector section; and a protrusion extending from the engaging member so as to be fitted into the fitting groove.

* * * * *